US007721810B2

(12) United States Patent
Weirich

(10) Patent No.: US 7,721,810 B2
(45) Date of Patent: May 25, 2010

(54) LARGE INSIDE DIAMETER COMPLETION WITH POSITION INDICATION

(75) Inventor: John B. Weirich, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/018,878

(22) Filed: Jan. 24, 2008

(65) Prior Publication Data

US 2009/0188676 A1 Jul. 30, 2009

(51) Int. Cl.
*E21B 33/12* (2006.01)
*E21B 43/04* (2006.01)

(52) U.S. Cl. ..... 166/387; 166/278; 166/51

(58) Field of Classification Search ..... 166/387, 166/278, 51, 134, 182
See application file for complete search history.

(56) References Cited

U.S. PATENT DOCUMENTS

| | | | | |
|---|---|---|---|---|
| 4,474,239 | A | 10/1984 | Colomb et al. | |
| 5,865,255 | A * | 2/1999 | Hammett et al. | 166/382 |
| 6,216,785 | B1 | 4/2001 | Archee, Jr. et al. | |
| 6,364,017 | B1 * | 4/2002 | Stout et al. | 166/278 |
| 6,464,006 | B2 * | 10/2002 | Womble | 166/276 |
| 6,513,599 | B1 * | 2/2003 | Bixenman et al. | 166/378 |
| 6,983,795 | B2 | 1/2006 | Zuklic et al. | |
| 7,032,666 | B2 | 4/2006 | Corbett | |
| 7,066,264 | B2 | 6/2006 | Bissonnette et al. | |
| 7,128,151 | B2 | 10/2006 | Corbett | |
| 7,290,610 | B2 | 11/2007 | Corbett et al. | |
| 7,373,979 | B2 | 5/2008 | Coronado et al. | |
| 2002/0195253 | A1 * | 12/2002 | Hill et al. | 166/380 |

OTHER PUBLICATIONS

Augustine, J., et al., "World's First Gravel-Packed Uniform Inflow Completion", SPE 103195, Sep. 2006, 1-10.
Lorenz, M., et al., "Advancement in Completion Technologies Proved Successful in Deepwater Frac-Pack and Horizontal Gravel-Pack Completions", SPE 103103, Sep. 2006, 1-22.
Bixenman, P.W., et al., "Design and Deployment of an Intelligent Completion with Sand Control", SPE 71674, Sep. 2001, 1-9.
Vickery, E. Harold, et al., "New One-Trip Multi-Frac Pack System with Positive Positioning", SPE 78316, Oct. 2002, 1-8.

* cited by examiner

*Primary Examiner*—David J Bagnell
*Assistant Examiner*—Elizabeth C Gottlieb
(74) *Attorney, Agent, or Firm*—Steve Rosenblatt

(57) ABSTRACT

A completion assembly has a packer for isolation and indicating shoulders incorporated into a sleeve mounted uphole of the packer. Locating the indicating shoulders above the packer allows them to be larger than placement below the packer where the assembly generally has to neck down to permit operations such as gravel packing. Placement above the packer makes the indicating shoulders less restrictive to subsequent production flow or for passage of tools further down the wellbore.

10 Claims, 2 Drawing Sheets

LARGE INSIDE DIAMETER COMPLETION WITH POSITION INDICATION

FIELD OF THE INVENTION

The field of this invention relates to downhole completion assemblies and more particularly to those that place the position locaters for through packer assemblies above the packer to reduce restriction presented by position locators traditionally placed below a completion packer.

BACKGROUND OF THE INVENTION

Gravel pack systems allow many downhole procedures to take place in a single trip. A gravel pack assembly typically contains sections of screen that extend from a packer. An inner string that includes a crossover tool is movable with respect to the set packer for selective sealing relation with a polished bore in the packer. In this manner fluids can be circulated when the assembly is run in and gravel can be deposited outside the screens while return fluids can come up through the screens and up a wash pipe. These return fluids can then pass through a valve in an uphole direction and go through the crossover and back to the surface through the annulus above the set packer. Alternatively, the crossover can allow the gravel to be deposited with fluid squeezed into the formation in a procedure called a frac pack. The crossover is simply positioned with respect to the packers and seal bores in a manner where no return port through the wash pipe and back to the surface is open.

Regardless of whether the gravel is deposited with fluid returns to the surface or whether the fluid is forced into the formation when the gravel is deposited outside the screens, the excess gravel in the string leading down to the crossover has to be removed, typically by a process called reversing out. In this step the crossover is repositioned so that fluid pumped from the surface in the annular space above the packer is allowed into the tubing above the packer so that the excess gravel can be brought to the surface. It is the locating of these positions downhole that is vital to the correct operation of the tool. Performing this procedure can build pressure near the crossover and a risk of fluid loss to the formation with this built up pressure is a possibility. Fluid loss to the formation can diminish its productivity and excessive fluid loss to the formation may inhibit or prevent reverse circulating of the excess gravel from the workstring. For these reasons a fluid loss control valve in the wash pipe extending into a packer seal bore from the crossover has been used. These fluid loss control valves are illustrated in patents relating to gravel packing operations such as U.S. Pat. Nos. 7,290,610; 7,128,151; 7,032,666 and 6,983,795.

As an introduction to an understanding of the preferred embodiment, a brief discussion of the prior designs and the issues it presented will be undertaken in a summary form. FIG. 1 shows a common prior art assembly for gravel packing. A wellbore 20 has a string 22 with a packer 24 shown in a set position. A crossover tool 26 with a wash pipe 28 extends through a screen assembly 30 that is properly located by a formation 31 using a tubular spacer 29. The screen assembly 30 has profiles 32 on which a collet 34 that is connected to the wash pipe 28 can be landed to provide the desired flow configurations for the gravel packing operation. In order to direct fluid flow it is necessary that the packer 24 sealing bore 38' be compatible with the crossover tool 26, such that the crossover tool seals in the seal bore. In the FIG. 1 position a fluid loss control valve 36 is locked in the open position. The FIG. 1 position allows circulation with flow coming down the string 22 and going through the crossover tool 26 to emerge outside the screen assembly 30. Flow then goes through the screen assembly 30 and into the wash pipe 28 and through the flow control valve 36 and back through the crossover tool 26 to the annulus above packer 24 and around the string 22 to the surface.

Note that in FIG. 1 the collet 34 is set down on one of the profiles 32 to define a circulating position. In FIG. 2 the collet 34 is back to the same position as in FIG. 1 to define a position for delivering gravel 27 either by circulation or by what's called a frac pack where the returns in the annulus 44 above the packer 24 are shut off at the surface. After that, further string manipulation in FIGS. 3 and 4 allows the collet 34 to indicate in different locations and directions on profiles 32 so as to place the internal assembly in position to evacuate excess gravel from the crossover tool 26 in FIG. 3 and from the string above the packer 24 in FIG. 4.

With this prior art configuration and the crossover tool 26 sealing in the packer 24 sealing bore 38' it was necessary to have the profiles 32 smaller than the packer 24 sealing bore 38'. As a result when the well is put on production, the profiles present resistance to production flow through the screen assembly 30.

The present invention is directed at finding an alternative location for these profiles and the preferred location is in a region above the packer where the profiles can be larger since the annulus above the packer need not be as large as below it since only screened returns pass through that annulus. These and other aspects of the present invention will become more apparent from a review of the description of the preferred embodiment and the associated drawing while recognizing that the appended claims define the literal and equivalent scope of the invention.

SUMMARY OF THE INVENTION

A completion assembly has a packer for zone isolation and indicating shoulders incorporated into a sleeve mounted uphole of the packer. Locating the indicating shoulders above the packer allows them to be larger than placement below the packer where the assembly generally has to neck down to create sealing points and a sufficiently large annular space to permit operations such as gravel packing. Placement above the packer makes the indicating shoulders less restrictive to subsequent production flow or for passage of tools further down the wellbore.

DETAILED DESCRIPTION OF THE PREFERRED EMBODIMENT

Figure 1:
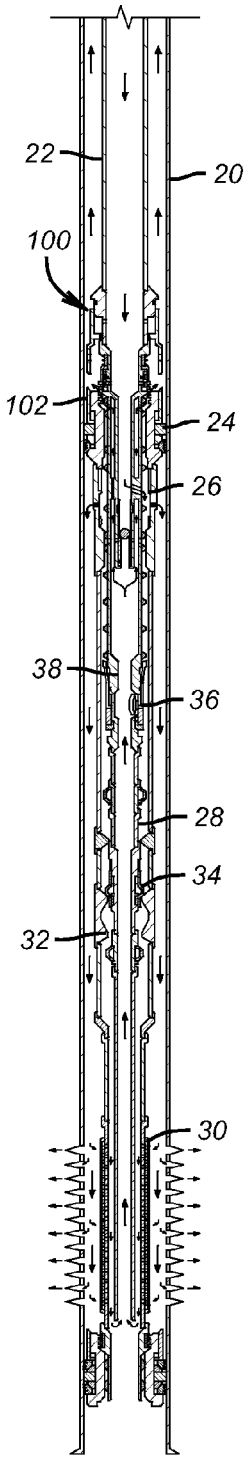
(PRIOR ART) FIG. 1
FIG. 1 is a section view of a gravel packing assembly known in the art in a circulating position.
Figure 2:
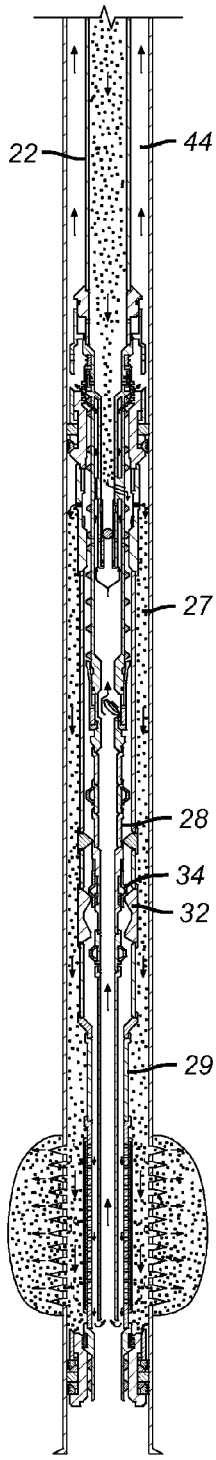
(PRIOR ART) FIG. 2
FIG. 2 is the view of FIG. 1 with the assembly in a frac pack mode.
Figure 3:
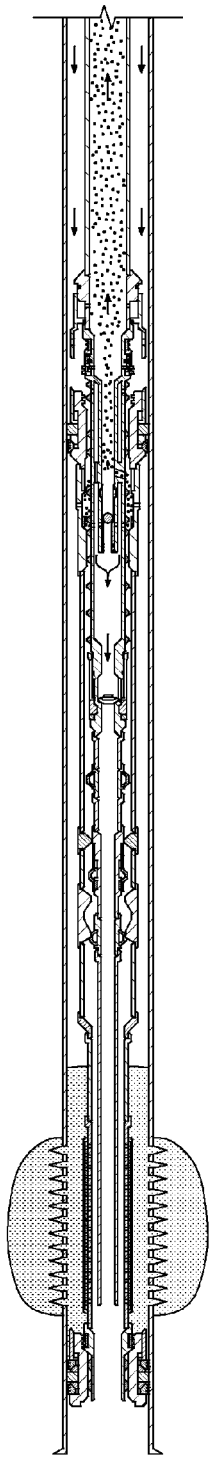
(PRIOR ART) FIG. 3
FIG. 3 is the view of FIG. 2 with the assembly in position to reverse out excess gravel from the crossover tool.
Figure 4:
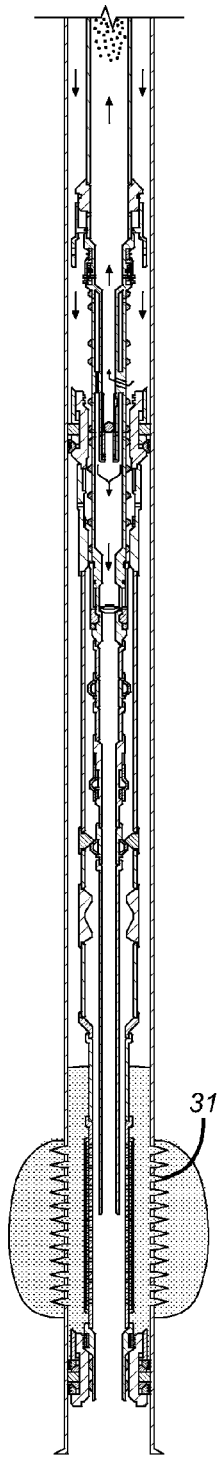
(PRIOR ART) FIG. 4
FIG. 4 is the view of FIG. 3 with the assembly in position to reverse out excess gravel from the string above the crossover.
Figure 5:
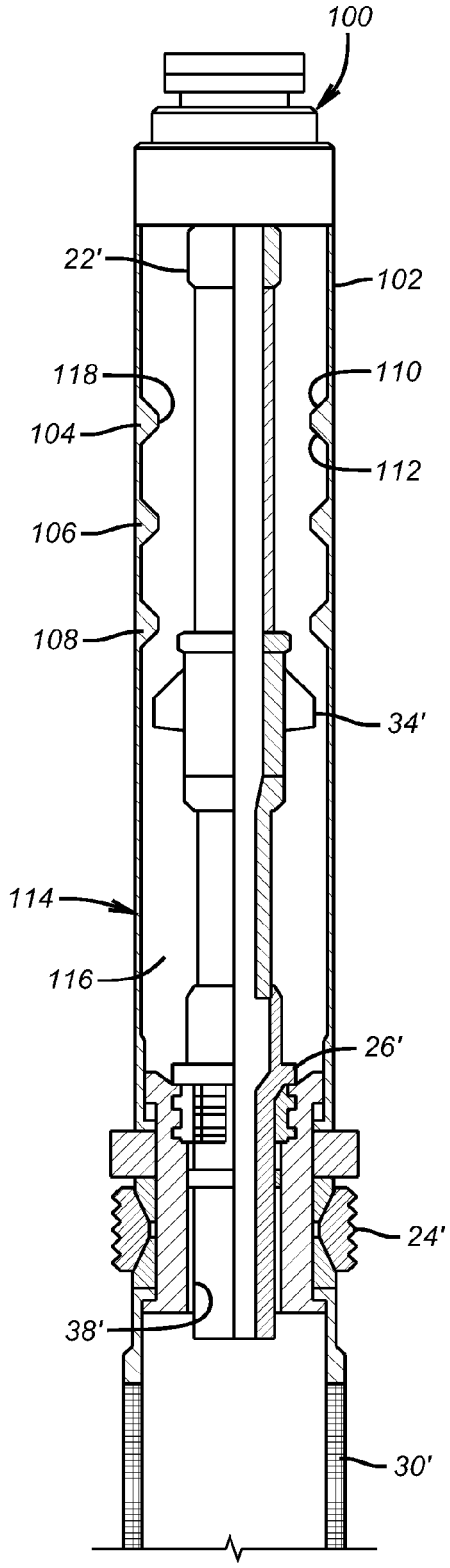
FIG. 5 is a section view of the present invention showing the indicating shoulders above the packer.

FIG. 5 shows the packer of FIGS. 1-4 and now labeled 24' as a quick way to understand the difference from the prior technique, described above in a gravel packing context, and the present invention applied to the same technique to illustrate one application of the present invention. The collet 34' is the same but it is now positioned above the packer 24' and still on string 22' which continues to the surface (not shown). A setting tool 100 is part of the string 22' and incorporates a sleeve 102 with preferably integrated landing shoulder assemblies 104, 106 and 108. The collet 34' can land on an upper surface such as 110 or a lower surface 112 on any of the landing shoulder assemblies. The crossover tool 26' is shown adjacent the packer 24'. In the FIG. 5 position, the crossover tool 26' is landed on the packer 24'. While such a position defined in the previous sentence could be accomplished in the design of FIGS. 1-4, there are multiple positions required to execute a procedure such as a frac pack or gravel pack and a single landing position of the crossover tool 26' on the packer 24' is not sufficient. Screen 30' is mounted below packer 24' with no indicating shoulders located between the packer 24' and screen 30'.

Optionally, flow control valve having a sleeve 200 to selectively cover a port 202 such as an RB valve offered by Baker Oil Tools can be placed in the sleeve 102 to control fluid flow into the formation. Setting sleeve 102 can set the packer by relative movement with respect to string 22' in a known manner. After performing the needed downhole operation the string 22' can be pulled taking with it the setting tool 100. A production string (not shown) can then be tagged into packer 24'. The profiles 32 shown in the prior design in FIGS. 1-4 are now larger than they were in the traditional gravel packing operation. For that reason they do not restrict the passage below the packer 24' as they used to do.

As an example the sleeve 102 can have an outside diameter of 8.125 inches while the peak 118 can have an inside diameter of 6.625 inches, which is larger than the seal bore 38' in the packer 24'. In the prior art location below the packer the peaks of the indicating shoulders 32 would be smaller than the packer seal bore 38 forcing a smaller string to be set in a sealing relationship with the packer 24 than in the present invention shown in FIG. 5 where the full seal bore diameter in the packer can be used without restriction from shoulder assemblies 104, 106 and 108 after the string 22' is pulled and a production string (not shown) is inserted.

I claim:

1. A downhole completion method for a zone defined at its upper end by an uphole packer, comprising:

setting the uphole packer having a seal bore to define an upper end of a zone to be completed downhole;

providing a plurality of indicating shoulders uphole of said uphole packer;

using said shoulders to reposition a service string with respect to said packer, said service string having at least one selectively collapsible engaging member thereon by selectively landing said engaging member on said indicating shoulders for selective support without extending said engaging member through said seal bore in said uphole packer.

2. The method of claim 1, comprising:

making the inside dimension at said indicating shoulders larger than the internal dimension of said seal bore.

3. The method of claim 1, comprising:

locating the indicating shoulders on a setting sleeve for the uphole packer.

4. The method of claim 1, comprising:

removing said service string;

inserting as large a production string into said seal bore in the uphole packer as such seal bore internal dimension can accept, after said removing of said service string.

5. The method of claim 1, comprising:

providing no indicating shoulders between the uphole packer and screens that said uphole packer supports.

6. The method of claim 2, comprising:

locating the indicating shoulders on a setting sleeve for the uphole packer.

7. The method of claim 6, comprising:

removing said service string;

inserting as large a production string into said seal bore in the uphole packer as such seal bore internal dimension can accept, after said removing of said service string.

8. The method of claim 7, comprising:

providing no indicating shoulders between the uphole packer and screens that said uphole packer supports.

9. The method of claim 3, comprising:

positioning a flow control valve on said setting sleeve.

10. The method of claim 6, comprising:

positioning a flow control valve on said setting sleeve.

* * * * *